US008052353B2

(12) United States Patent
Oldsen et al.

(10) Patent No.: US 8,052,353 B2
(45) Date of Patent: Nov. 8, 2011

(54) SYSTEM AND METHOD FOR MINE ROOF COUNTER BORE AND CABLE BOLT HEAD SECUREMENT THEREIN

(75) Inventors: John G. Oldsen, Butler, PA (US); John C. Stankus, Canonsburg, PA (US); Demrey G. Brandon, Pittsburgh, PA (US); Joey B. Blankenship, Bluefield, WV (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 268 days.

(21) Appl. No.: 12/147,981

(22) Filed: Jun. 27, 2008

(65) Prior Publication Data

US 2009/0003940 A1 Jan. 1, 2009

Related U.S. Application Data

(63) Continuation-in-part of application No. 11/500,173, filed on Aug. 7, 2006.

(60) Provisional application No. 60/706,827, filed on Aug. 9, 2005.

(51) Int. Cl.
*E21D 23/00* (2006.01)

(52) U.S. Cl. ..... 405/302.1; 405/259.1; 405/259.4

(58) Field of Classification Search .... 405/259.1–259.6, 405/262, 302.1

See application file for complete search history.

(56) References Cited

U.S. PATENT DOCUMENTS 0,654,861 A 7/1900 Tynan
3,090,203 A 5/1963 Durget
4,079,766 A 3/1978 Conley et al.
4,095,431 A 6/1978 Hannan
4,523,881 A 6/1985 Ringe
4,708,559 A 11/1987 Locotos
4,746,248 A * 5/1988 Lillis et al. ..... 405/259.5
4,859,118 A * 8/1989 Schaeffer ..... 405/259.3
5,064,311 A 11/1991 Giroux et al.
5,253,960 A * 10/1993 Scott ..... 405/302.2
5,259,703 A 11/1993 Gillespie
5,511,909 A 4/1996 Calandra, Jr. et al.
5,586,839 A 12/1996 Gillespie
5,628,587 A 5/1997 Lesslie
5,769,570 A 6/1998 Stankus et al.
5,791,823 A 8/1998 Blakley et al.
5,791,824 A 8/1998 Radtke
5,791,828 A 8/1998 Fergusson
5,919,006 A 7/1999 Calandra et al.
5,934,855 A 8/1999 Osterle et al.
5,954,456 A 9/1999 Bowles
6,056,482 A 5/2000 Calandra, Jr. et al.
6,322,290 B1 11/2001 Calandra, Jr. et al.

(Continued)

*Primary Examiner* — David Bagnell
*Assistant Examiner* — Benjamin Fiorello
(74) *Attorney, Agent, or Firm* — The Webb Law Firm

(57) ABSTRACT

A mine roof support includes a plate having a raised portion with an opening, and a mine and roof bolt, e.g. a barrel having a drive end and an opposite second end, and wedge assembly. The plate mates with a recess in a mine roof. In one embodiment, the second end of the barrel extends through the opening in the dome into a bore hole in the mine roof. In another embodiment, a second end of the mine bolt is contoured to match and fill the inner contour of the dome. A drill bit tool used to shape the recess includes a first bit, a second bit, and a third bit between the first and second bits to drill a bore hole, enlarge the end of the bore hole to receive the second end of the mine bolt, and to drill the recess.

6 Claims, 13 Drawing Sheets

U.S. PATENT DOCUMENTS 6,428,243 B1 8/2002 Hutchins
6,457,909 B1 10/2002 Xu et al.
6,619,888 B2 9/2003 Calandra, Jr. et al.
6,648,557 B1 11/2003 Morrow et al.
6,682,268 B2 1/2004 Robertson, Jr. et al.
6,881,015 B2 4/2005 Wallstein et al.
2003/0143038 A1 7/2003 Babcock
2004/0135422 A1* 7/2004 Wallstein et al. ..... 299/31
2004/0161316 A1 8/2004 Locotos et al.
2005/0013672 A1 1/2005 Slater

* cited by examiner

SYSTEM AND METHOD FOR MINE ROOF COUNTER BORE AND CABLE BOLT HEAD SECUREMENT THEREIN

CROSS REFERENCE TO RELATED APPLICATIONS

This application is a continuation-in-part of U.S. patent application Ser. No. 11/500,173 filed on Aug. 7, 2006, and entitled "System and Method for Mine Roof Counter Bore and Cable Bolt Head Securement Therein," and claims the benefit of U.S. Provisional Patent Application No. 60/706,827, filed Aug. 9, 2005, and entitled "System and Method for Mine Roof Counter Bore and Cable Bolt Head Securement Therein," the contents of which are incorporated herein by reference.

BACKGROUND OF THE INVENTION

1. Field of the Invention

The present invention relates generally to a mine roof support and, more particularly, to a mine roof support including a crater plate having a dome or raised portion on one side to provide a recess on the other side, and a cable bolt head positioned in the recess of the crater plate.

2. Description of Related Art

In mine work, such as coal mining, or in underground formations, such as tunnels or other excavations, it is necessary to reinforce or support the roof and/or walls of the excavation to prevent rock falls or cave-ins. Among the most common means presently in use for effecting such support are cable bolts or other suitable elongated members, such as rod bolts, which are inserted into bore holes and exposed to a resin mixture or anchored therein to hold a metal support or bearing plate in tight engagement with the roof or wall surface. With respect to cable bolts, a resin system introduces resin capsules or cartridges into the bore hole and then advances the capsules to a blind end of the bore hole by the cable bolt backing the capsules. The spinning of the cable bolt ruptures the capsules and mixes the resin system supplied. Examples of prior art cable bolt arrangements are disclosed in U.S. Pat. Nos. 6,428,243; 5,586,839; and 5,064,311.

Each of the cable or rod bolts in the aforementioned prior art utilizes either a barrel and wedge assembly or a bolt head, respectively, to secure the metal support or bearing plate against the roof. Therefore, for example, the barrels of the cable bolts extend into the usable walk/crawl or transportation space in a mine, as defined by the distance from the floor to the ceiling of a mine tunnel. FIG. 1 depicts a prior art cable bolt including a multi-strand cable 3 secured to a barrel and wedge assembly 2 and situated with respect to a roofline of a mine. A washer 4 may be secured between a prior art bearing plate 6 and an existing barrel 8. A drive head, such as a nut 9, may be attached to a free end of the cable 3. An exemplary height of the prior art barrel and wedge assembly 2 is approximately three inches. Accordingly, several inches (not including the thickness of the prior art bearing plate 6) of material extends below the roofline. The prior art barrel and wedge assembly 2 used in connection with typical low-clearance tunnels requires that due care be exercised while moving within the tunnel, as the extending bolt heads may be engaged by moving equipment or mine personnel.

SUMMARY OF THE INVENTION

Accordingly, there is a need to provide a mine roof support that limits the extent a bolt head protrudes beyond a roofline of a tunnel. Specifically, a system and method are needed for creating a mine roof counter bore adapted to receive a plate to be seated therein and a portion of a mine roof bolt therein. It is to be understood that the term mine roof bolt is to encompass a cable bolt, a rod bolt, a torque tension bolt and the like. Accordingly, either a barrel of a cable bolt or a head of a rod bolt may be sufficiently recessed within a recess of the plate to provide more vertical clearance within the tunnel. The resultant mine roof support should be cost-effective, easily installable and provide sufficient structural support for the roof. The foregoing need for an improved mine roof support is met by the present invention.

The present invention includes a mine roof support for use with a recess formed within a mine roof. The mine roof support includes a plate and a mine roof bolt. The plate includes (a) a raised portion defining a cavity; (b) a planar portion extending from the raised portion, wherein the planar portion is configured to be received adjacent the mine roof surrounding the recess; and (c) an opening within the raised portion. A first side of the raised portion is shaped to substantially correspondingly mate with the portion of the mine roof defining the recess.

The mine roof bolt may be a cable bolt having a barrel and wedge assembly. The mine roof bolt includes a drive end that extends through the opening and is at least partially received within the cavity. Alternatively, the cavity of the plate may be sized to substantially receive the entire barrel and drive end therein. A second side of the raised portion of the plate may include a portion surrounding the opening that accommodates a surface of the barrel thereagainst. A top portion of the barrel and wedge assembly may be planar and may conform to a planar surface of the second side of the raised portion of the plate. In another embodiment, the top portion of the barrel and wedge assembly may be contoured (e.g., curved) to conform to the second side of the raised portion of the plate. In yet another embodiment, a spherical washer may be positioned between a contoured surface of the raised portion of the plate and a planar surface of the barrel and wedge assembly. One end of the barrel may define a socket dimensioned to receive a drive tool to impart rotational force thereon.

A method of positioning a drive end of the mine roof bolt at least partially above a roofline of a mine includes (a) drilling a bore hole into the mine roof, wherein the bore hole is sized to receive the mine roof bolt therein; (b) drilling a recess into the mine roof to produce a recessed roofline, wherein the recess is situated below the bore hole and adjacent the roofline; (c) inserting a plate having a raised portion into the recess, wherein the raised portion defines a cavity within the plate, and wherein the recessed roofline matingly receives a first side of the raised portion; (d) inserting the mine roof bolt through an opening in the plate and into the bore hole and the recess of the mine roof; and (e) positioning the drive end of the mine roof bolt at least partially into the cavity. A drill bit tool may be provided having a first drill bit sized to drill the bore hole and a second drill bit sized to drill the recess.

A method of supporting the mine roof includes the aforementioned steps with respect to positioning the drive end of the mine roof bolt at least partially above the roofline of a mine with the addition of inserting a resin cartridge into the first hole and rotating the mine roof bolt. Accordingly, the resin cartridge is ruptured and resin contained therein is released within the bore hole, whereby the resin secures the mine roof bolt within the bore hole.

The drill bit tool for drilling into the mine roof includes a shaft, a first drill bit, and a second drill bit. The first drill bit is situated at a first end of the shaft, wherein the first drill bit is sized to drill a bore hole in the mine roof to accommodate a mine roof bolt therein. The second drill bit has a curved cross-section. The second drill bit is positioned on the shaft and is distal from the first end thereof, wherein the second drill bit is sized to drill a recess in the mine roof sized to accommodate the plate therein. The second drill bit is fixedly secured to the shaft. The shaft may include a coupling for removably connecting a portion of the shaft having the first drill bit to a portion of the shaft having the second drill bit. The second drill bit may be movably secured to the shaft by a locking member.

Another non-limiting embodiment of the invention relates to a mine roof support for use with a recess formed within a portion of a mine roof. The mine roof support includes, among other things, a plate having a raised portion defining a cavity and an opening within the raised portion, wherein a first side of the raised portion is shaped to substantially correspondingly mate with the portion of the mine roof defining the recess, and a mine roof bolt having a drive end and an outer surface substantially correspondingly with inner surface of the cavity, wherein the drive end of the mine roof bolt fills the cavity.

Another non-limiting embodiment of the invention relates to a mine roof support for use with a recess formed within a portion of a mine roof. The mine roof support includes, but is not limited to, a plate having a first side, an opposite second side, wherein the first side has a raised portion and the second side has a cavity, and an opening within the raised portion, wherein the first side at the raised portion is shaped to substantially correspondingly mate with the portion of the mine roof defining the recess, and a mine roof bolt having a drive first end, and an opposite second end, wherein a portion of the drive end of the mine roof bolt between the first end and the second end of the roof is in the opening and a portion of the drive first end of the mine roof bolt is in the cavity.

A further non-limiting embodiment of the invention relates to a method of positioning a drive end of a mine roof bolt at least partially above a roofline of a mine. The method includes, among other things, drilling a bore hole having a diameter into the mine roof, wherein the bore hole is sized to receive the mine roof bolt therein; enlarging end of the bore hole adjacent the roof line, the enlargement sized to receive leading end of mine roof bolt; drilling a recess into the mine roof to produce a recessed roofline, wherein the recess is situated below the enlarged end of the bore hole and adjacent the roofline; inserting a plate having a raised portion into the recess of the mine roof, wherein the raised portion defines a cavity within the plate; inserting the mine roof bolt through an opening in the plate and into the bore hole, and positioning the drive end of the mine roof bolt at least partially into the cavity.

A still further non-limiting embodiment of the invention relates to a drill bit tool for drilling into a mine roof. The drill bit tool includes, among other things, a shaft; a first drill bit situated at a first end of the shaft, wherein the first drill bit is sized to drill a bore hole having a constant diameter in the mine roof to accommodate a mine roof bolt therein; a second drill bit positioned on the shaft and distal from the first end thereof, wherein the second drill bit is sized to drill a recess in the mine roof sized to accommodate a plate therein; and a third drill bit between the first drill bit and the second drill bit, the third drill bit having a diameter that increases as the distance from the first drill increases.

These and other advantages of the present invention will be understood from the description of the preferred embodiments, taken with the accompanying drawings, wherein like reference numerals represent like elements throughout.

DETAILED DESCRIPTION OF THE INVENTION

The present invention will now be described with reference to the accompanying figures. It is to be understood that the specific apparatus and system illustrated in the attached figures and described in the following specification is simply an exemplary embodiment of the present invention.

Figure 2:
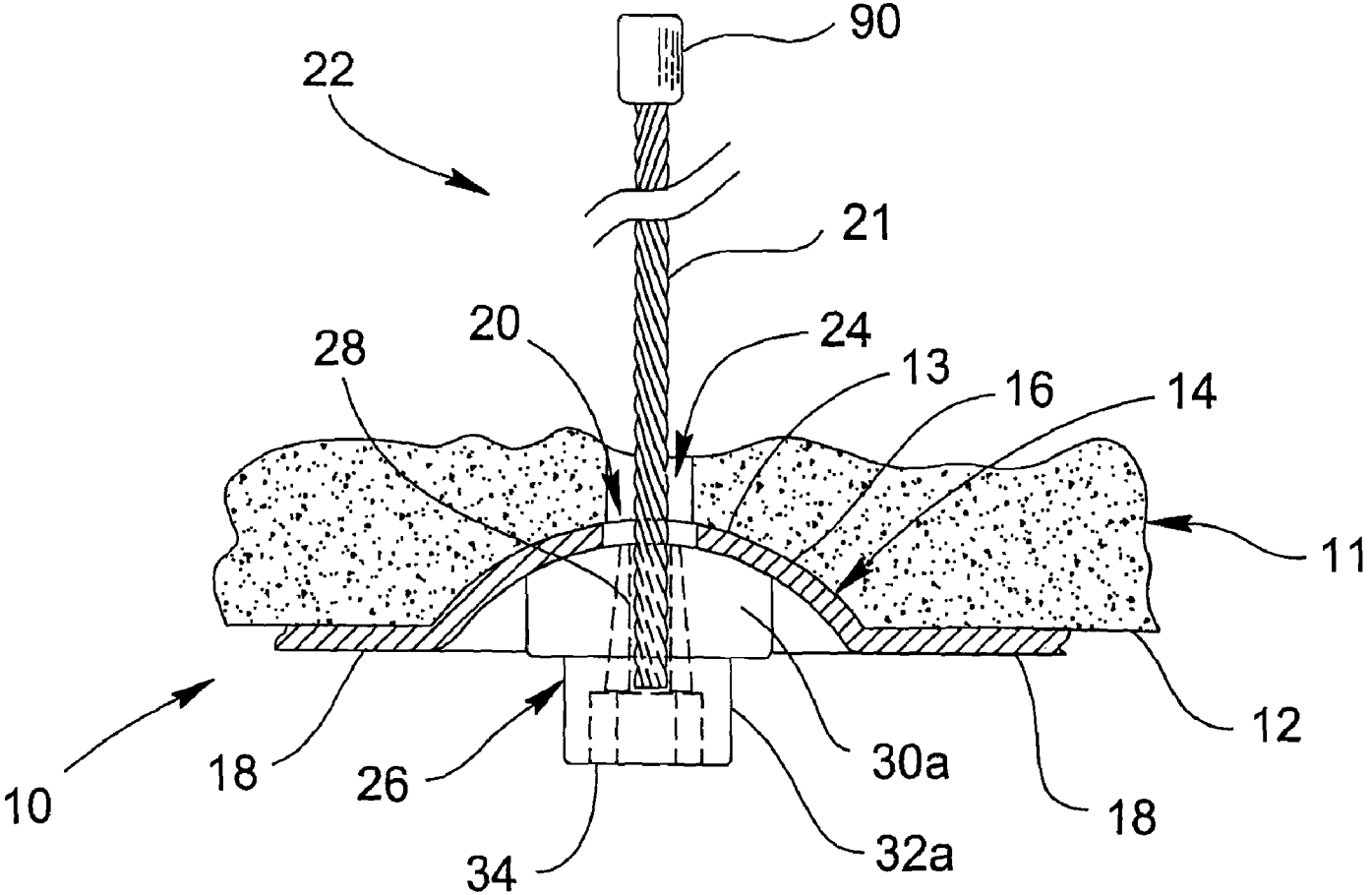
FIG. 2 is a partial sectional view of a mine roof support in accordance with a first embodiment of the present invention.
Figure 3:
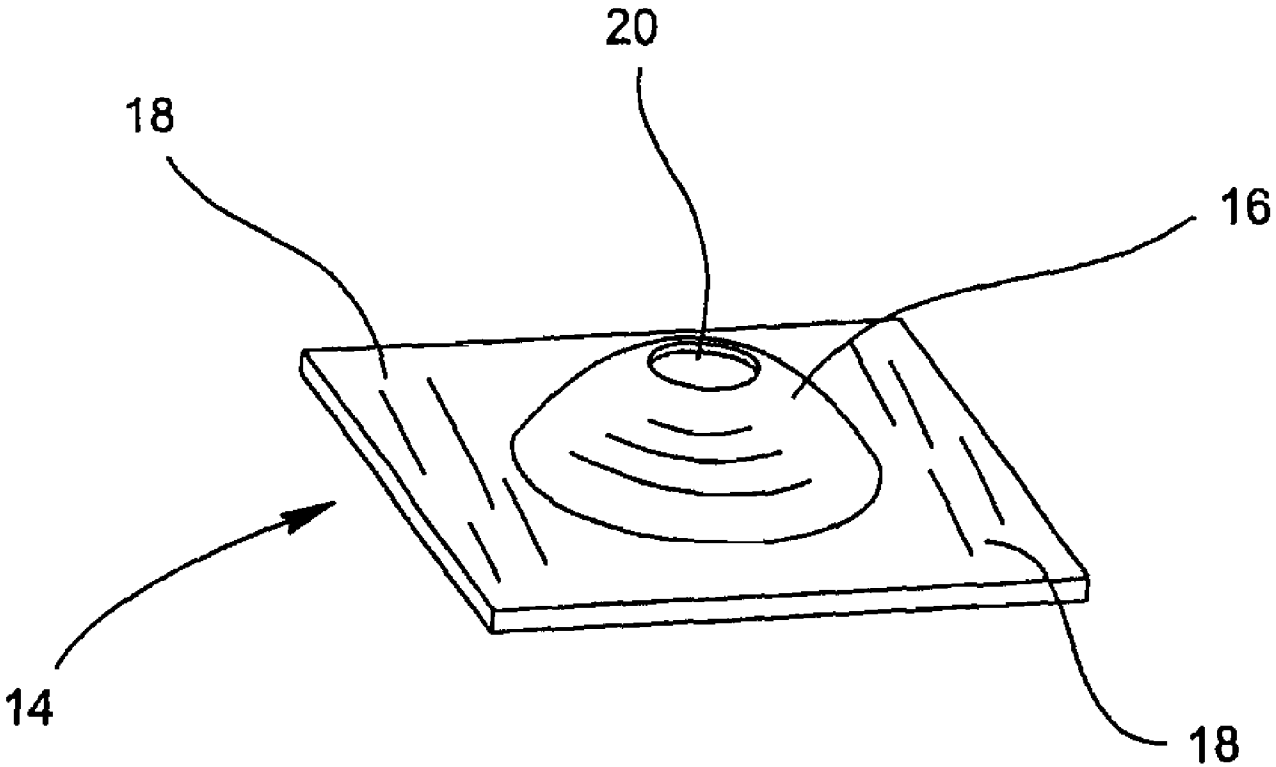
FIG. 3 is a perspective view of a crater plate in accordance with the present invention.
Figure 4A:
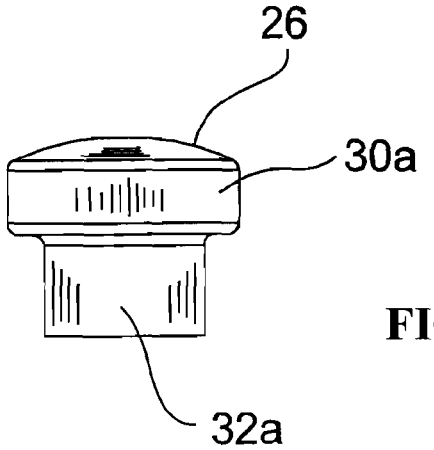
FIG. 4A is a side view of a barrel used in connection with the mine roof support of FIG. 2.
Figure 4D:
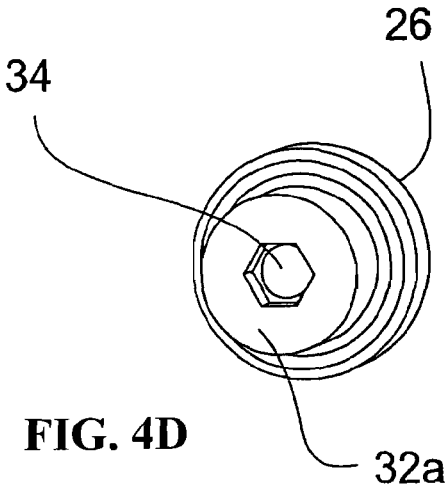
FIG. 4D is a lower perspective view of the barrel of FIG. 4A.
Figure 4B:
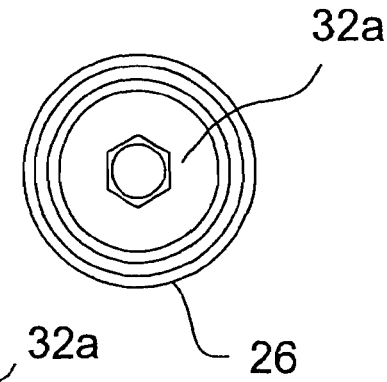
FIG. 4B is a bottom view of the barrel of FIG. 4A.
Figure 4C:
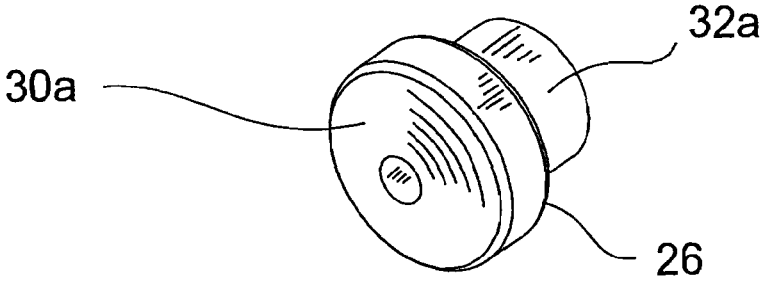
FIG. 4C is an upper perspective view of the barrel of FIG. 4A.
Figure 5:
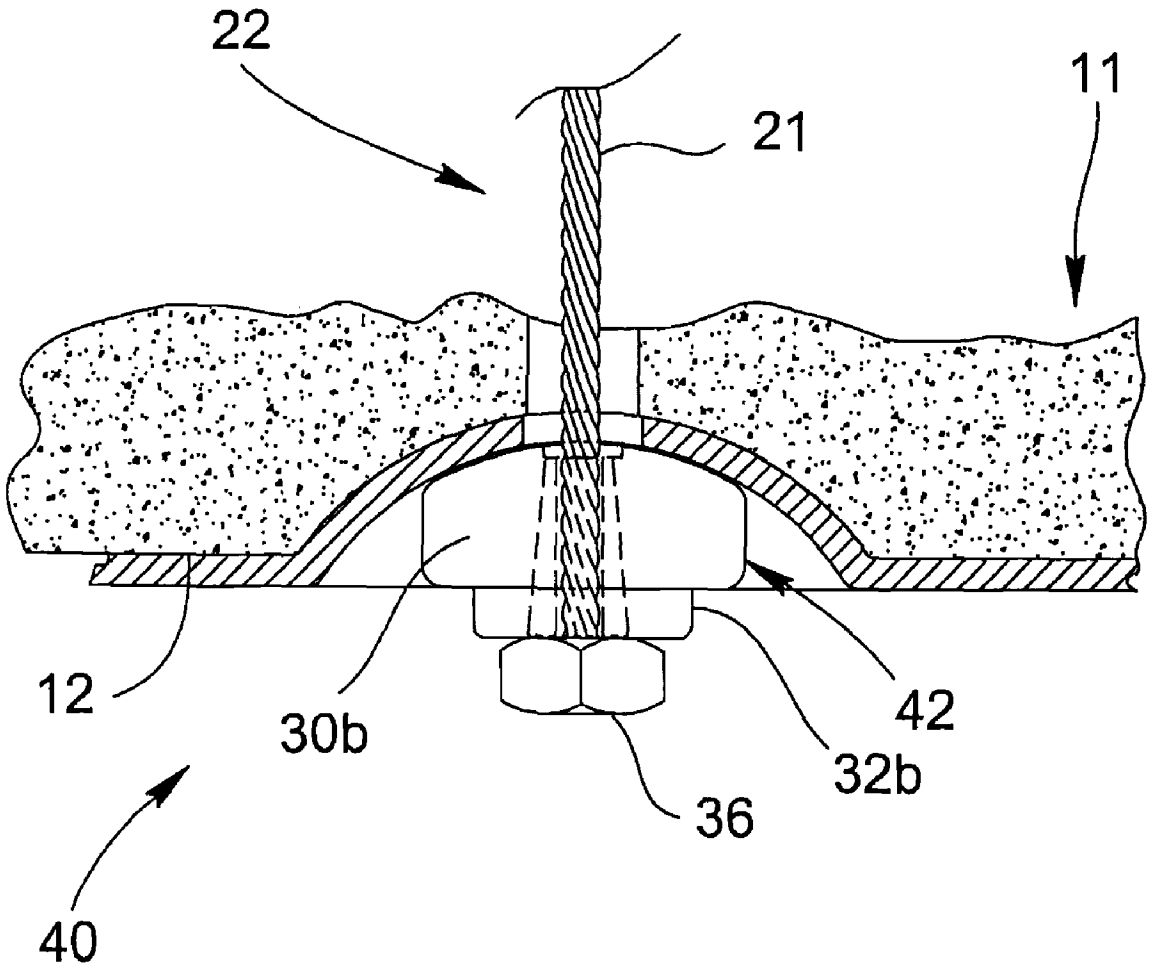
FIG. 5 is a partial sectional view of a mine roof support utilizing a cable bolt in accordance with a second embodiment of the present invention.

With reference to FIG. 2, a first embodiment mine roof support 10 is shown secured to the rock strata of a roof 11 of a mine or other excavated tunnel. A roofline 12 is defined by a lowermost portion of the roof 11. It is to be understood that the term "roofline" may encompass other mining surface areas, including walls. A counter-sunk recess 13, which may have a generally curved profile, such as substantially semi-spherical, and is referenced to herein as a crater sink 13, is formed through the roofline 12 into the roof 11 to accommodate a crater plate or dome plate 14 therein. As shown in FIGS. 2 and 3, the crater plate 14 includes a raised portion 16 that substantially corresponds to the shape of the crater sink 13. Edges 18 extending from the raised portion 16 define the length and width of the crater plate 14. An exemplary crater plate 14 has overall dimensions of eight inches by eight inches; however, it is to be understood that other suitably sized plates may be utilized. Accordingly, the crater plate 14 may be mated with the roof by having the raised portion 16 positioned within the crater sink 13 and the edges 18 positioned against the roof 11 and, more specifically, extending along the roofline 12. By mating the raised portion 16 with the roof 11 surrounding the crater sink 13 (the portion of the roof surrounding the crater sink 13 referred to herein as the recessed roofline), the crater plate 14 exerts pressure or support along its entire upper surface adjacent the roof 11.

The crater plate 14 may be sized to accommodate any angled orientations of an axis of the crater sink 13 with respect to the roofline 12. For example, the depth of one side of the raised portion 16 of the crater plate 14 may be greater than another side of the raised portion 16. In the context of a wall (not shown), a recess would be formed into the wall and, desirably, the edges 18 of the crater plate 14 would be situated substantially parallel with respect to the wall; however, it is to be understood that an axis of the crater sink 13 may be formed in an angled orientation with respect to the plane of the wall.

The crater plate 14 defines an opening 20 to accommodate a mine roof bolt therein. It is to be understood herein, that the term mine roof bolt is to encompass a cable bolt, a rod bolt, a torque tension bolt or the like. Therefore, all references made to a cable bolt with a barrel and wedge assembly are to be equally applicable to a rod bolt with head or torque tension bolt with nut, unless specifically indicated otherwise. As used herein, a drive end of a mine roof bolt is not meant to be limiting and may refer to (a) a barrel and wedge assembly (or the like) of a cable bolt; (b) a drive head including a threaded end of either a cable bolt or rod bolt with a drive nut (or the like), such as in a torque tension bolt; and (c) a drive head including a forged head (or the like) of either a cable bolt or rod bolt. In addition, the mine roof bolt described herein may be resin anchored or mechanically anchored using an expansion anchor at the distal end thereof or both. The opening 20 may accommodate a cable 21 of a cable bolt 22 therethrough. In an exemplary embodiment, the opening 20 may be one inch in diameter; however, it is to be understood that the opening 20 may be of various sizes depending on the width of the cable 21. As is known in the art, a bore hole 24 is drilled into the roof 11 to accommodate the cable bolt 22 or other securement mechanism, such as any type of mine roof bolt, therein. The opening 20 of the crater plate 14 is substantially aligned with the bore hole 24, such that a central axis of the opening 20 is substantially co-axial with a central axis of the bore hole 24.

With respect to the first embodiment mine roof support 10 incorporating a cable bolt 22, a barrel 26 is adapted to accommodate one or more wedges 28. As is known in the art, the wedges 28 co-act with the barrel 26 to secure the free end of the cable 21 extending downwardly from the opening 20. One embodiment of the barrel 26 is shown in FIGS. 4A-4D. Desirably, the barrel 26 is constructed of steel; however, other suitable materials may be utilized. Furthermore, it is to be understood that other shapes and sizes conducive to decreased manufacturing costs, sufficient strength, etc., may be used for the barrel 26. The barrel 26 includes a top portion 30*a* and a bottom portion 32*a*. The top portion 30*a* may be larger than the bottom portion 32*a* and may extend beyond vertical edges defining the bottom portion 32*a*. The top portion 30*a* of the barrel 26 is desirably contoured to correspond to an inner curved portion of the curved raised portion 16 of the crater plate 14. In this manner, the barrel 26 may exhibit a mushroom shape, which may be produced as a casting. The bottom portion 32*a* of the barrel 26 defines a socket 34 dimensioned to receive a correspondingly-sized drive tool (not shown) to mate therewith and impart a rotational force thereon. For example, if the drive tool is hexagonally-shaped, then the socket 34 is also hexagonally-shaped to provide a corresponding fit to the drive tool. It is to be understood that the hexagonal shape of the socket 34 depicted in the accompanying figures is shown for exemplary purposes only and that other shapes may be used to allow the drive tool to engage the barrel 26.

With continuing reference to FIGS. 2, 3, and 4A-4D, FIG. 5 depicts another embodiment of the present invention. A mine roof support 40 includes many of the same components as used with the mine roof support 10 with the exception of a barrel 42 having a top portion 30*b* configured similarly to the top portion 30*a* of the barrel 26 and a bottom portion 32*b* having a smaller length than the bottom portion 32*a* of the barrel 26 and foregoing the socket 34. Instead, a nut 36 secured to the cable 21 of the cable bolt 22 is situated externally and adjacent the bottom portion 32*b* of the barrel 42. The nut 36 may be secured to the cable 21 by press fitting or the like, such as described in U.S. Pat. No. 6,322,290, incorporated herein by reference. Apart from the socket feature of the first embodiment mine roof support 10, the overall functionalities of the mine roof support assemblies 10 and 40 are similar. However, the reduced length of the bottom portion 32*b* of the barrel 42 minimizes the extent to which the mine roof support assembly 40 extends below the roofline 12.

Figure 6:
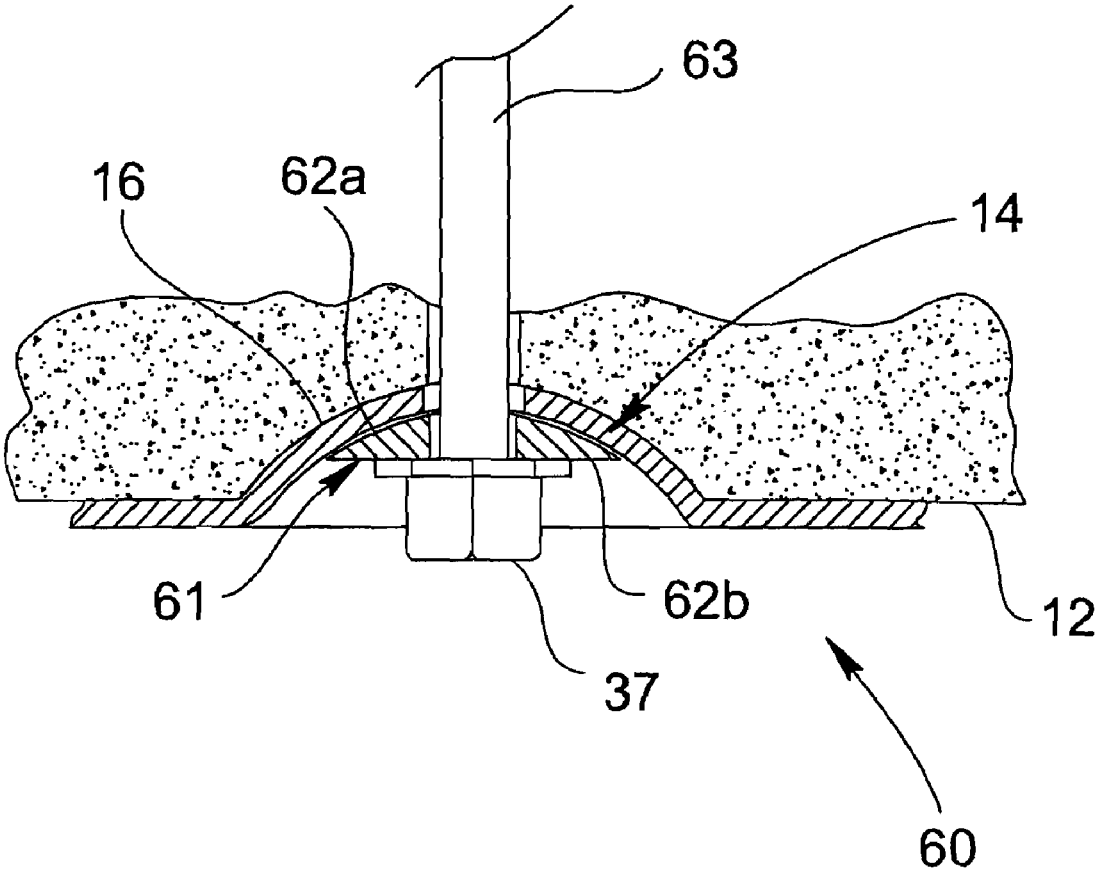
FIG. 6 is a partial sectional view of a mine roof support utilizing a rod bolt in accordance with a third embodiment of the present invention.

With continuing reference to the aforementioned figures, FIG. 6 depicts a third embodiment mine roof support 60 utilizing a spherical or contoured washer 61. In prior art roof plate applications, misalignment of a bolt and plate during installation may generate forces on the plate and end attachment of the bolt and, thereby, reduce overall strength of the support. It is, therefore, desirable to compensate for any such misalignment. Accordingly, the present invention incorporates the use of the spherical washer 61 to provide the desired self-alignment without reliance on other compensating fixtures.

Figure 1:
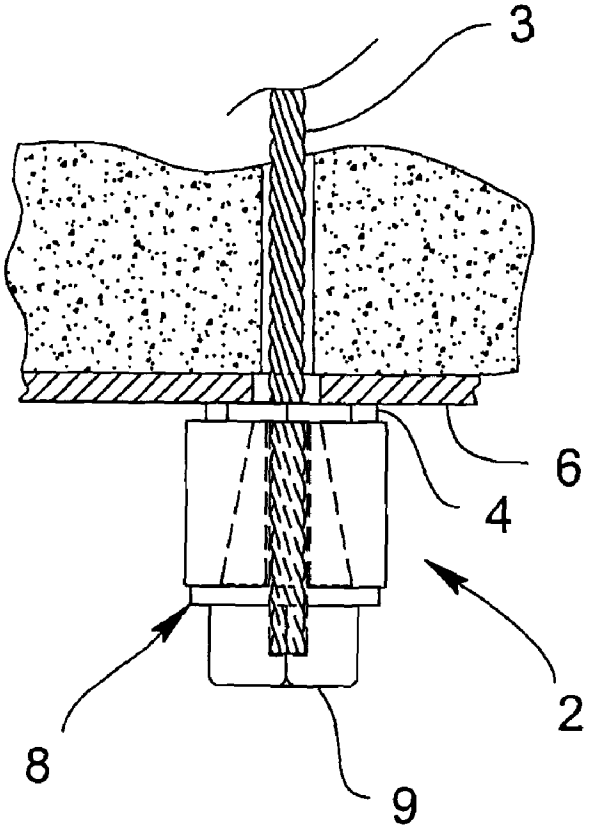
FIG. 1 PRIOR ART
FIG. 1 is a partial sectional view of a prior art cable bolt, wherein the prior art cable bolt protrudes entirely below a roofline.

The spherical washer 61 includes a surface 62*a* that corresponds to the inner curve of the curved raised portion 16 of the crater plate 14 and an opposing surface 62*b* adapted to be seated substantially flush against a surface of a barrel and wedge assembly of a cable bolt. In one desirable embodiment, the top portion of the spherical washer 61 is substantially semi-spherical; however, it is to be understood that the spherical washer 61 may embody any shape that corresponds to the particular shape of the crater plate 14. The spherical washer 61 may be used in connection with either a cable bolt or a rod bolt. For example, as shown in FIG. 6, a rod bolt 63 having a fixed head, such as a nut 37, may be placed substantially flush against the surface 62*b*. The third embodiment mine roof support 60, therefore, may be at least partially above the roofline 12 similarly to the mine roof support assemblies 10 and 40. It is to be understood that the present invention may also be utilized with a cable bolt bearing a conventional barrel and wedge assembly (as shown in FIG. 1), without requiring substitute or specialized barrel forms, such as the barrels 26 or 42. It should be understood that the mine roof support systems described herein (such as systems 10, 40 and 60) may be used in conjunction with an additional bearing plate disposed between the edges 18 and the roofline 12 (with the raised portion 16 extending through an opening therein) for extending the load further to the mine roof 11.

Figure 6A:
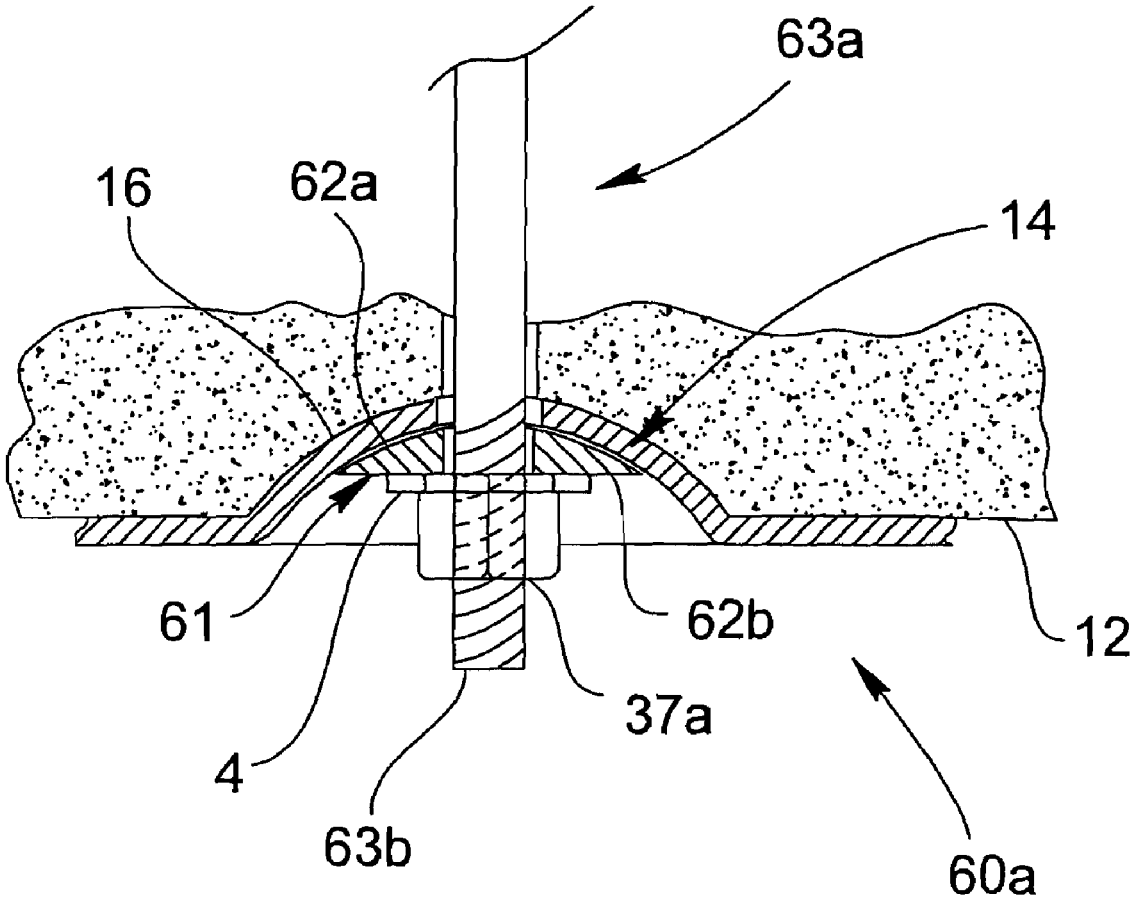
FIG. 6A is a partial sectional view of a mine roof support utilizing a torque tension bolt made in accordance with the present invention.

FIG. 6A shows a fourth embodiment of a mine roof support system 60*a* of the present invention that utilizes a torque tension bolt 63*b* and tensioning nut 37*a*, which may be resin anchored or mechanically anchored at its distal end, such as disclosed in U.S. Pat. No. 6,619,888, incorporated herein by reference. The bolt 63*b* may be used with a spherical washer 61 and optional flat washer 4.

Figure 7:
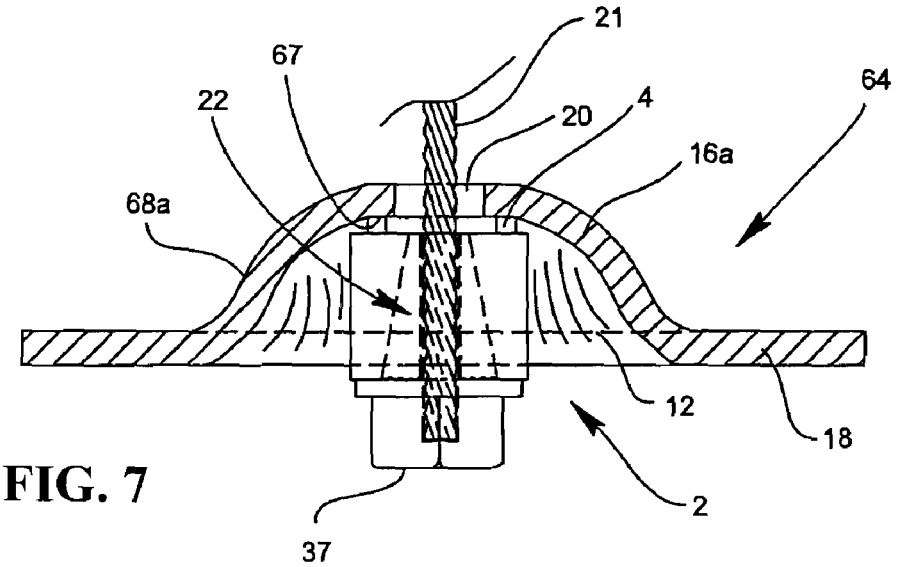
FIG. 7 is a partial sectional view of an alternative embodiment crater plate with a cable bolt partially protruding past the roofline.
Figure 8:
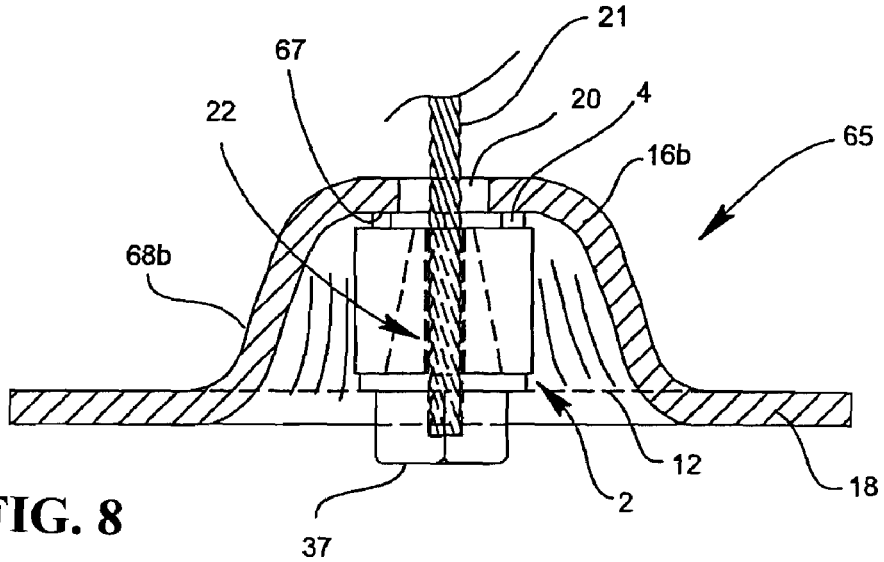
FIG. 8 is a partial sectional view of another alternative embodiment crater plate with a cable bolt slightly protruding past the roofline.
Figure 9:
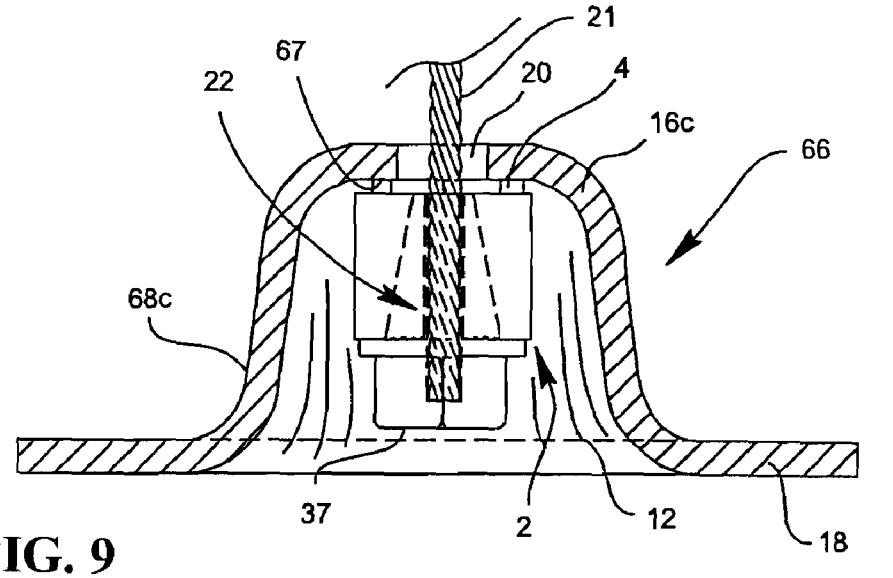
FIG. 9 is a partial sectional view of a third alternative embodiment crater plate with a cable bolt substantially fully recessed above the roofline.
Figure 10:
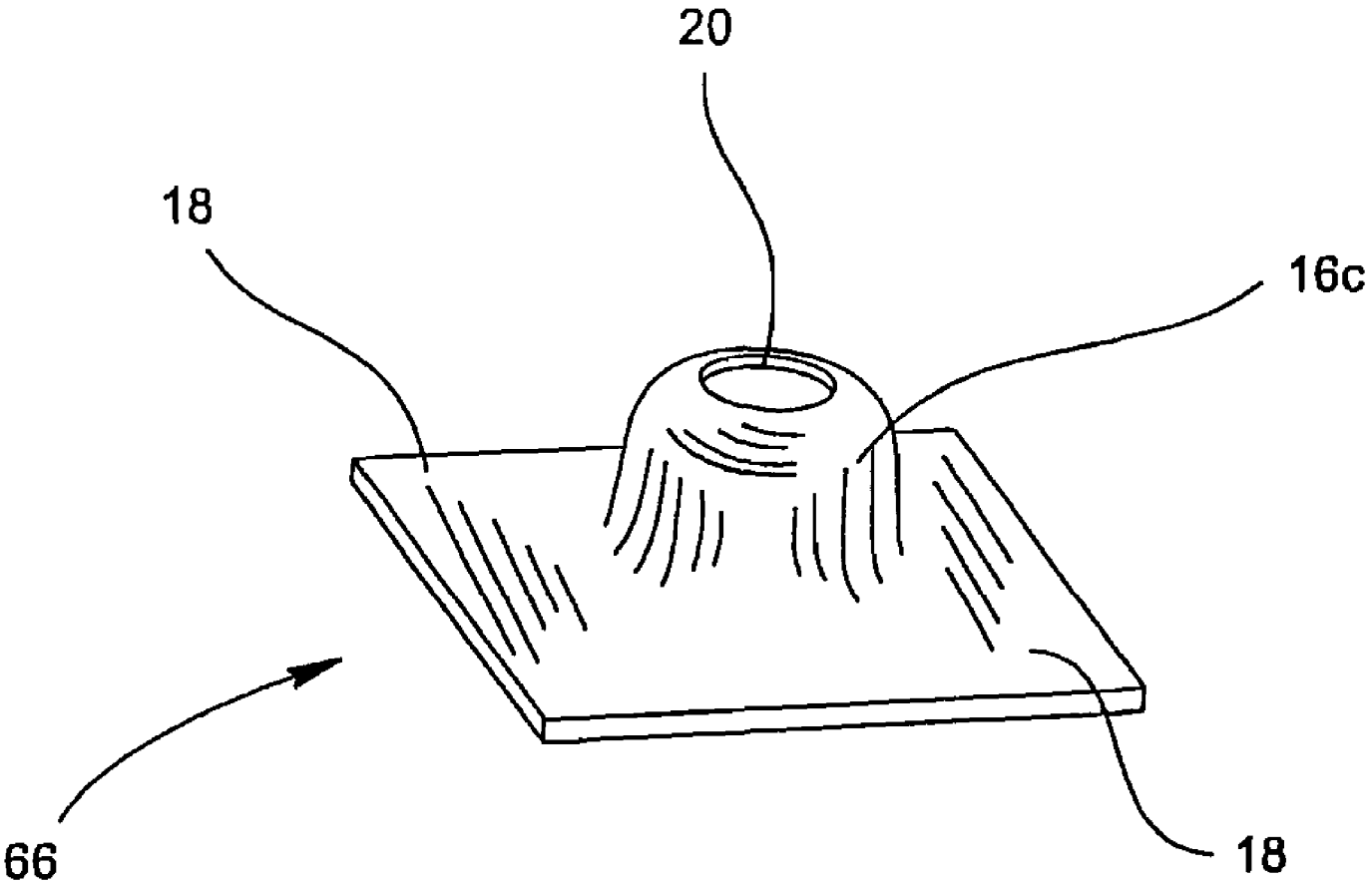
FIG. 10 is a perspective view of the crater plate shown in FIG. 9.

FIGS. 7-9 depict alternative embodiment crater plates 64, 65, 66, respectively. Each of these crater plates 64, 65, 66 serve similar functions as crater plate 14. Accordingly, the crater plates 64, 65, 66 include a respective curved raised portion 16*a*, 16*b*, 16*c*, the edges 18, and the opening 20. However, in contrast to the crater plate 14, in which a distinct intersection point between the raised portion 16 and the edges 18 is defined, the crater plates 64, 65, 66 include corresponding raised portions 16*a*, 16*b*, 16*c* that merge in a curved manner into the respective outlying edges 18. Specifically, the first, second and third alternative embodiment crater plates 64, 65, 66 encompass an uninterrupted curved cross-sectional design. Crater plates 64, 65, 66 each include a substantially flat area 67 defined around the opening 20 that is sufficiently sized to accommodate the end components of a mine roof bolt flush thereagainst. For example, a conventional barrel and wedge assembly 2, as shown in FIG. 7 with or without a washer 4, may be used with the crater plates 64, 65, 66 without the use of the spherical washer 61 or additional hardware. The crater plates 64, 65, 66 differ from each other with respect to the height of the curved raised portions 16*a*, 16*b*, 16*c* in relation to the edges 18. This height establishes the extent of draw associated with production of each of the crater plates 64, 65, 66. As shown in FIGS. 7-9, generally, an increased depth of recess in the crater plates 64, 65, 66 increases the grade or slope of respective sides 68*a*, 68*b*, 68*c* of the curved raised portions 16*a*, 16*b*, 16*c*. As shown in FIG. 10, the crater plate 66 has a larger raised portion 16*c* with a deeper recess than shown for the crater plate 14 of FIG. 3. The length of the edges 18 may be the same or different for each of the crater plates 64, 65, 66. To illustrate the varying degrees of draw, the respective interior heights of the crater plates 64, 65, 66 may be: 1 35/64 inches; 2 9/32 inches; and 3 inches. However, it is to be understood that the aforementioned dimensions are not to be construed as limiting the invention.

Figure 11:
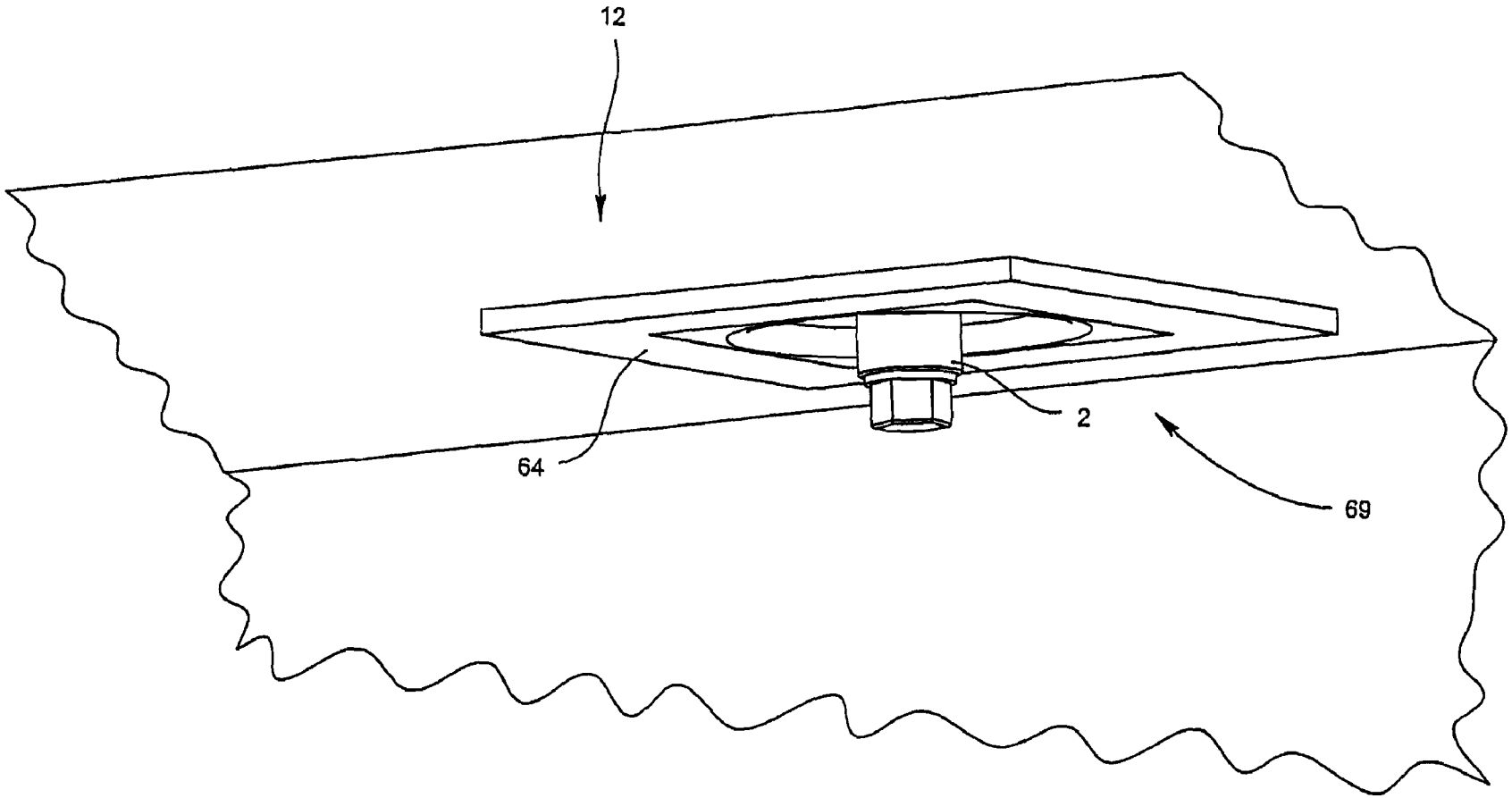
FIG. 11 is a perspective view of an installed mine roof support in accordance with the present invention using the crater plate shown in FIG. 7.

The depth of the recess associated with each of the crater plates 64, 65, 66, can control the extent to which the drive end of a mine roof bolt (a barrel and wedge assembly 2, bolt head, nut or the like) extends below the roofline 12. With reference to FIGS. 7 and 11, for example, approximately half of the barrel and wedge assembly 2 is recessed within the crater plate 64 of a mine roof support 69. Accordingly, a portion of the barrel and wedge assembly 2 still extends below the roofline 12. In contrast, as shown in FIG. 9, approximately the entire barrel and wedge assembly 2 is recessed within the crater plate 66 such that no portion of the nut 37 extends below the roofline 12. It is to be understood that the aforementioned examples of crater plates with varying degrees of draw (depth of recess) are not to be considered as limiting the invention. Accordingly, deeper drawn embodiments of crater plates may be designed to fully accommodate a variety of barrel and wedge assemblies or other mine roof bolting components.

Figure 12:
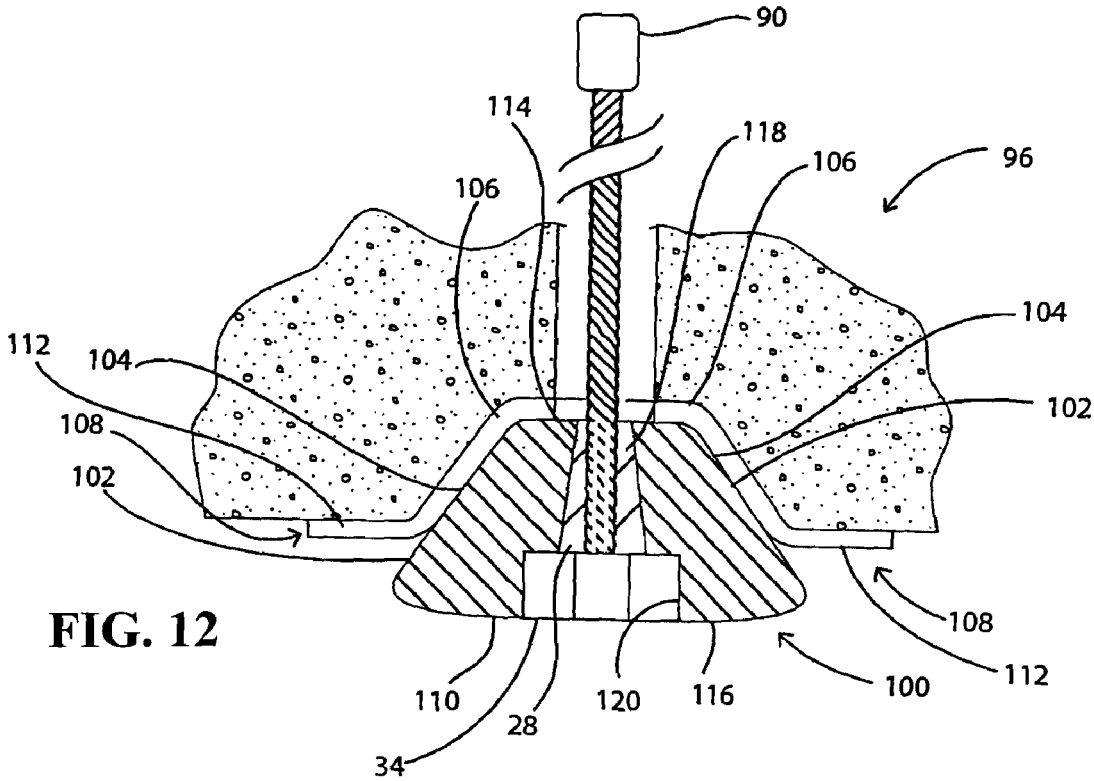
FIG. 12 is a partial sectional view of a mine roof support in accordance with a fifth embodiment of the present invention.
Figure 13:
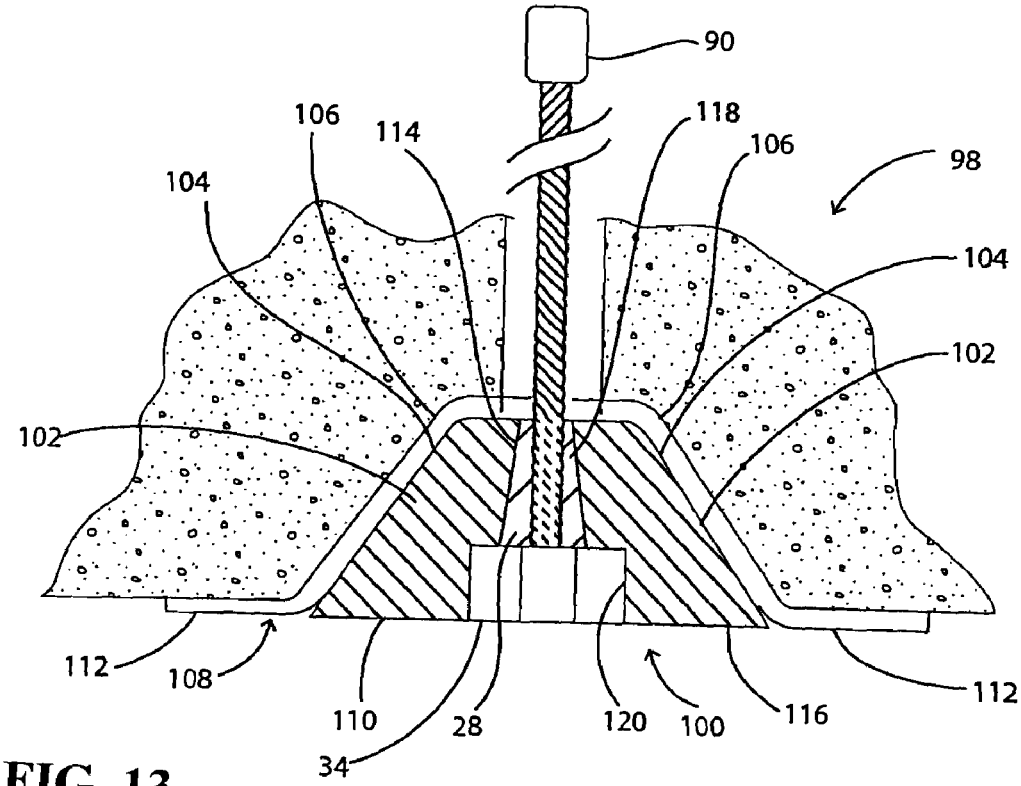
FIG. 13 is a partial sectional view of a mine roof support in accordance with a sixth embodiment of the present invention.

Fifth and sixth non-limiting embodiments of a mine roof support system of the invention designated by the numbers 96 and 98, respectively, are depicted in FIGS. 12 and 13, respectively. Barrel 100 shown in FIGS. 12 and 13 has a frustum conical outer surface 102 sized and shaped to correspond to inner curved surface 104 of dome or raised portion 106 of crater plate 108. Optionally, the base 110 of the barrel 100 can extend beyond edges 112 of the crater plate 108 as shown in FIG. 12, or the base 110 of the barrel 100 is level with edges 112 of the crater plate 108 as shown in FIG. 13. The barrel 100 includes a center hole 114 extending through body 116 of the barrel 100. Portion 118 of the center hole 114 of the barrel 100 has a wedge shape similar to the wedge shape of the top portion 30 of the barrel 26 shown in FIGS. 4A-4D to receive the wedges 28 (see also FIG. 2). The center hole 114 terminates at the base 110 of the barrel 100 with a hexagonal shape hole 120 to receive a socket 34 in a similar manner as the barrel 26 (see FIGS. 2 and 4A-4D.). In a preferred non-limiting embodiment of the invention, the outer surface 102 of the barrel 100 completely engages the inner surface 104 of the dome 106 to provide additional structural support for dome 106 of the crater plate 108.

Figure 14:
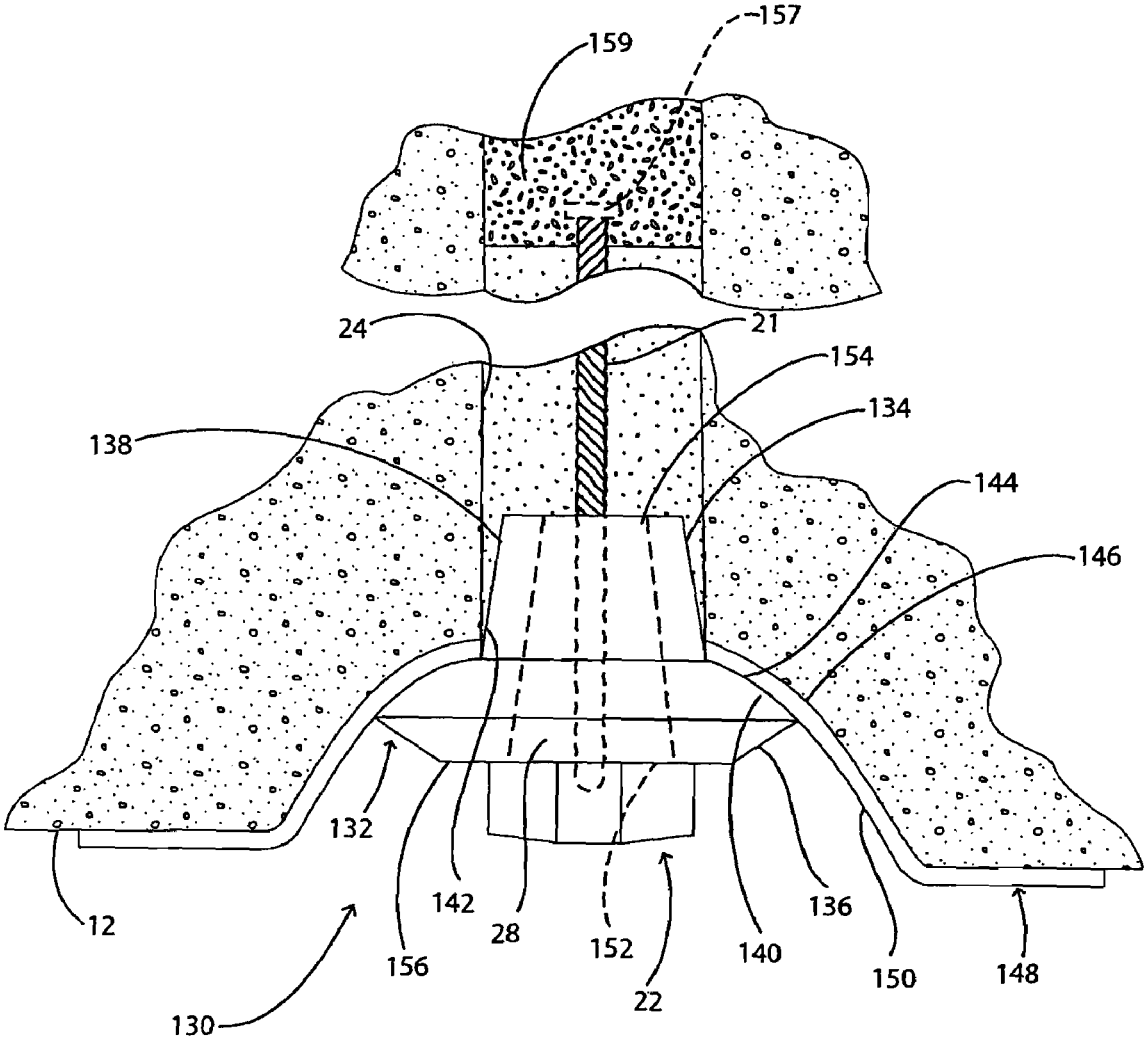
FIG. 14 is a partial sectional view of a mine roof support in accordance with a seventh embodiment of the present invention.

The seventh non-limiting embodiment of the invention eliminates the need to have deeper draws of the crater plate to recess the entire barrel and wedge assembly within the crater plate 66, such that no portion of the nut 37 extends below the roofline 12, as shown in FIG. 9. With reference to FIG. 14, the seventh non-limiting embodiment of a mine roof support system of the invention designated by the number 130 includes a barrel 132 having a top portion 134 and a bottom portion 136. The top portion 134 has a frustum conical shaped outer surface 138, and the bottom portion 136 has a spherical outer shaped top surface 140. The diameter of intersection 142 of the surfaces 138 and 140 of the barrel 132 is smaller than the diameter of hole 144 in dome 146 of crater plate 148. In this manner, the frustum conical shaped top portion 134 of the barrel 132 can pass through the hole 144 in the dome 146, and the surface 140 of the barrel 132 can engage the inner surface 150 of the dome 146, as shown in FIG. 14. A center hole 152 extends from end 154 of the barrel 132, and through the barrel 132 to opposite end 156. The hole 152 has increasing diameter from the end 154 to the opposite end 156 to receive the wedges 28 engaging the cable 21 of the cable bolt 22. As is appreciated by those skilled in the art, the wedges 28, cable 21 and the barrel 132 are unitized in any convenient manner, e.g. and not limiting to the invention, the wedges are positioned on the cable, and the wedges and cable are forced into the center hole of the barrel. In one non-limiting embodiment of the invention, the crater plate 148 and the unitized barrel 132, the wedges 28 and the cable 21 are secured to the roofline 12 as follows. The bore hole 24 is drilled into the roofline 12 in a manner discussed below. The resin cartridge 90 (see FIG. 2) is placed in the bore hole. End 157 of the cable 21 is passed through the hole 144 in the dome 146 of the crater plate 148 into the bore hole 24 in the roofline into the resin cartridge 90 (see FIG. 2). The end 157 of the cable 21 is secured in the bore hole 24 in any convenient manner, for example, but not limiting to the invention by resin adhesive 159, as discussed below.

Although in the discussion of the seventh non-limiting embodiment of the mine roof support system of the invention, a cable nut and a resin adhesive were used to secure the crater plate in position on the roofline, the invention is not limited thereto, and any of the arrangements discussed in the other non-limiting embodiments of the invention, or used in the practice of securing a crater plate to a roofline can be used with the barrel 132 of the invention to secure a crater plate to the roof line 12. Further, the invention contemplates shaping the bore hole 24 adjacent the roof line 12 to have sloping inner surfaces corresponding to the frustum conical shaped outer surface 138 of the top portion 134 of the barrel 132.

Figure 16:
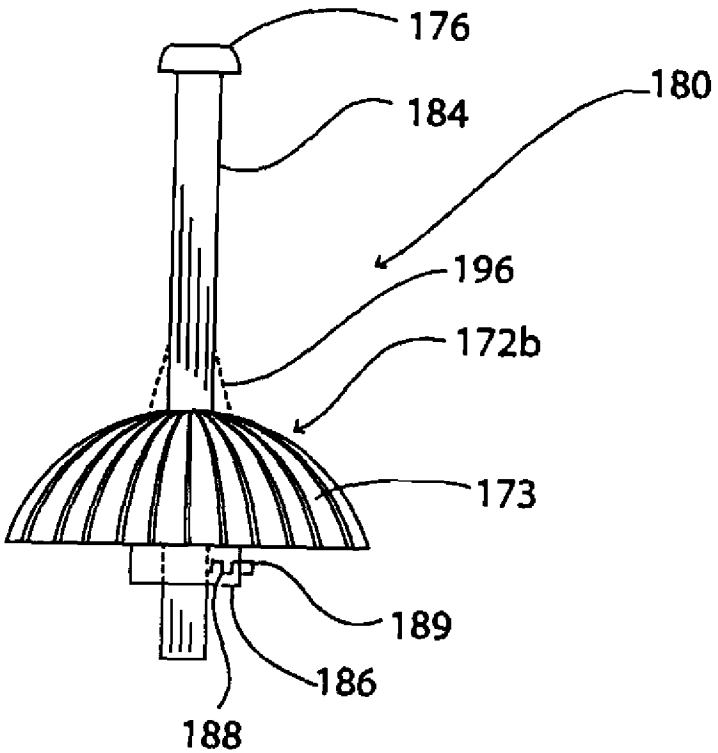
FIG. 16 is an elevation view of another drill bit tool in accordance with the present invention.
Figure 15:
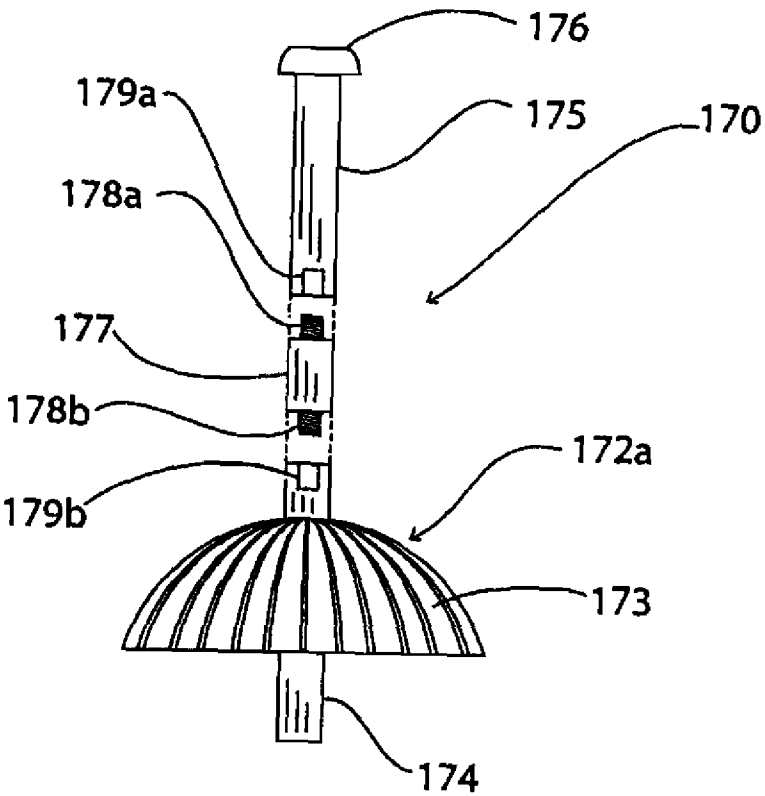
FIG. 15 is an exploded elevation view of a drill bit tool in accordance with the present invention.

With reference to FIGS. 15 and 16, the present invention further includes drill bit tools for forming the crater sink 13 with respect to mining applications. A first embodiment drill bit tool 170 includes a counter bore bit 172*a* fixedly secured to a first drill shaft 174. The counter bore bit 172*a* is sized to create the crater sink 13, such that the crater plate 14 may correspondingly mate therewith. Thus, it is to be understood that the counter bore bit 172*a* may assume various shapes and sizes depending on the type of crater plate 14 utilized. The counter bore bit 172*a* may include raised cutting surfaces or protrusions, such as ribs 173. A second drill shaft 175 with a bore hole bit 176 attached thereon is removably secured to the first drill shaft 174 via a coupling 177. The bore hole bit 176 is designed to drill the bore hole 24 to a sufficient width that may accommodate the cable 21 therein. The second drill shaft 175 may be of various lengths. The coupling 177 may include two male ends 178*b*, 178*a* adapted to be received by corresponding female ends 179*b*, 179*a* of each of the first and second drill shafts 174, 175. Thus, more than one coupling 177 may be utilized to increase the overall length of the first embodiment drill bit tool 170, as needed, depending on the desired depth of the bore hole 24. In the exemplary embodiment shown in FIG. 15, the respective male ends 178*a*, 178*b* and female ends 179*a*, 179*b* include threads for threadably engaging one another. Alternatively or in combination with multiple couplings 177, different lengths of the second drill shaft 175 may be used to achieve the desired depth of the bore hole 24. It is to be understood that other coupling mechanisms may be utilized and that the coupling arrangement disclosed herein is for exemplary purposes only.

A second embodiment drill bit tool 180 is depicted in FIG. 16 and includes a counter bore bit 172*b* that is movably secured onto a drill shaft 184 via a locking member 186 or other suitable engaging mechanism. The counter bore bit 172*b* may be similar to the counter bore bit 172*a* with respect to the raised cutting surfaces or protrusions, such as the ribs 173. The locking member 186 may be a solid component having a throughbore (not shown) sized to receive the drill shaft 184 therethrough. The locking member 186 may include a threaded hole 188 extending through the locking member 186 to the throughbore thereof in a substantially perpendicular relation to the drill shaft 184. A threaded member 189 may be threadably received within the threaded hole 188. The position of the counter bore bit 172*b*, with respect to the depth of the bore hole 24 drilled by the bore hole bit 176, may be adjusted by moving the counter bore bit 172*b* at various positions along the drill shaft 184. Thereafter, the threaded member 189 may be tightened against the drill shaft 184 to lock the counter bore bit 172*b* into place. It is to be understood that the coupling 177 may also be utilized in connection with the second embodiment drill bit tool 180.

The aforementioned first embodiment drill bit tool 170 and second embodiment drill bit tool 180 are but exemplary embodiments of drill bit tools that may be used to create the crater sink 13. For example, to form a crater sink that accommodates the crater plate 66, a drill bit sized to correspond to the outer dimensions of the curved raised portion 16*c* of the crater plate 66 may need to be provided. Further, the drill bit tools, e.g. the drill bit tool 180, can have ribs 190 positioned above the ribs 173 (shown in phantom in FIG. 16) to shape the bore hole 24 adjacent the roof line 12 to receive the frustum shaped outer surface 138 of the top portion 134 of the barrel 132, as discussed above. It can now be appreciated, that it is to be understood that the aforementioned drill bit tools 170, 180 may be modified to provide a correspondingly and suitably sized crater sink to accommodate a correspondingly sized crater plate and portion of a barrel.

An exemplary installation utilizing the aforementioned components includes selecting a section of wall or roof into which the crater sink 13 is to be formed. Thereafter, the depth of the drill bit tool 170 or 180 is adjusted to form the desired sized bore hole 24. The drill bit tool 170 is then used to drill the bore hole 24 with the accompanying crater sink 13. It is to be understood that the crater sink 13 and the bore hole 24 may be formed using two separate and distinct drill bits. For example, one drill bit (not shown), may be used to form the crater sink 13, whereas another drill bit (not shown) may be used to form the bore hole 24. These two drill bits may, therefore, be used independently of each other to form the crater sink 13 and the bore hole 24. Thereafter, a scraping tool (not shown) or equivalent may be used to prepare the resultant surface of the crater sink 13 to ensure that the respective surface mating areas will provide the requisite alignment between the crater plate 14 and the crater sink 13. The crater plate 14 is placed within the crater sink 13, such that the opening 20 substantially is co-axially aligned with the bore hole 24. A resin cartridge 90 (as shown in FIG. 2) is then inserted into the bore hole 24, preferably urged therein by the mine roof bolt, such as via the cable bolt 22, for example. The cable bolt 22 is inserted through the opening 20 of the crater plate 14. In an exemplary embodiment, the cable bolt 22 is forced upwardly into the bore hole 24 under the force of a bolter boom (not shown), while simultaneously rotating the cable bolt 22 to rupture the resin cartridge 90 and thoroughly mix and distribute the resin adhesive material contained therein. Specifically, the resin adhesive material is forced into the cracks and crevices within the rock formation of the mine roof, and also into the crevices and spaces between the individual strands of the cable 21. After the resin adhesive material is thoroughly mixed, the cable bolt 22 is held in place by the boom for a period of time sufficient to permit the resin to cure. Accordingly, the barrel of the cable bolt 22 is now situated at least partially within the crater sink 13, whereby the barrel is situated at least partially above the roofline 12.

It is to be understood that the dimensions described herein and in the accompanying drawings are for exemplary purposes only and are not to be construed as limiting the invention. As previously discussed, the present invention may be used in the context of rod bolts, torque tension bolts or cable bolts depending upon the mine roof application. While the present invention has been primarily described in reference to use with a cable bolt, rod bolts, having a fixed (e.g., forged) head or threaded head (e.g., torque tension bolt), may likewise be employed.

In still another embodiment of the present invention, the plate may be generally planar with the drive end of the mine roof bolt having a surface for mating with the recessed roofline, wherein the drive head partially extends through the plate opening and has a bearing surface retained by the plate.

The present invention has been described with reference to the preferred embodiments. Modifications, combinations and alterations will occur to others upon reading the preceding detailed description. It is intended that the invention be construed as including all such modifications, combinations and alterations insofar as they come within the scope of the appended claims or the equivalents thereof.

The invention claimed is:

1. A mine roof support for use with a recess formed within a portion of a mine roof, the mine roof support comprising:

a plate comprising a first surface and an opposite second surface; the first surface of the plate having a raised portion; the second surface of the plate having a cavity, and an opening within the raised portion, wherein a first side of the raised portion has a frustum conical outer surface and an opposite second side of the raised portion has the cavity, wherein the cavity has a frustum conical inner surface, and the outer surface of the raised portion of the plate and the portion of the mine roof defining the recess are shaped to substantially correspondingly mate with one another, and a mine roof bolt having a drive end, the drive end having a frustum conical outer surface substantially correspondingly mating with the frustum conical inner surface of the cavity, wherein the drive end of the mine roof bolt fills the cavity, wherein the mine roof bolt is a cable bolt comprising a barrel having a first end and an opposite second end, a passageway extending from the first end to the second end, wherein a diameter of the passageway increases as the distance from the first end in a direction toward the second end increases to receive a wedge assembly to secure an end of a cable to the cable bolt, and the passageway at the second end has a shaped opening to receive a drive tool to rotate the cable bolt and, wherein the first end of the barrel is positioned in the cavity and an outer surface of the barrel substantially corresponds with, and is in facing relationship to, the inner surface of the cavity and the cable bolt fills the cavity.

2. The mine roof support of claim 1, wherein the second end of the barrel is the drive end and a portion of the barrel having the drive end extends out of the cavity of the plate.

3. The mine roof support of claim 2, wherein the shaped opening at the second end of the barrel defines a socket dimensioned to receive a drive tool to impart rotational force to the barrel.

4. The mine roof support of claim 1, wherein the second end of the barrel is the drive end, and the drive end is totally within the cavity of the plate.

5. The mine roof support of claim 1, wherein the first end of the cable is secured in the mine roof.

6. A mine roof support for use with a recess formed within a portion of a mine roof, the mine roof support, comprising:

a plate having a first side, an opposite second side wherein the first side has a raised portion and the second side has a cavity, and an opening within the raised portion, wherein the first side at the raised portion is shaped to substantially correspondingly mate with the portion of the mine roof defining the recess, and a mine roof bolt having a drive end the drive end having a barrel comprising a first end portion, and an opposite second end portion, wherein a wedge assembly is within the second portion of the barrel, and the first end portion of the barrel comprises a first surface facing the second end portion and an opposite second surface facing away from the second end portion, wherein the opening of the plate, and the second end portion and the first surface of the barrel are sized to pass the second end portion of the barrel through the opening of the plate to space an end of the second end portion from the first side of the plate into the recess of the mine roof and to move the first surface of the barrel into surface contact with an inner surface of the cavity surrounding the opening to prevent the first end portion of the barrel from moving through the opening of the plate;

wherein the mine roof bolt is a cable bolt and the cable bolt comprises a first end and an opposite second end, wherein the second end of the cable bolt is the drive end having the barrel; the opening within the cavity has a diameter, and the second end portion of the barrel has a diameter, wherein the diameter of the second end portion of the barrel is smaller than the diameter of the opening, and an outer diameter of the second portion of the barrel increases as the distance from the second end of the barrel increases, wherein an outer diameter of the first surface of the barrel is greater than the diameter of the opening within the raised portion to prevent the first surface of the barrel from passing through the opening within the cavity, and wherein the first end of the cable bolt defines a socket dimensioned to receive a drive tool to impart rotational force on the barrel.

* * * * *

UNITED STATES PATENT AND TRADEMARK OFFICE

CERTIFICATE OF CORRECTION

PATENT NO. : 8,052,353 B2
APPLICATION NO. : 12/147981
DATED : November 8, 2011
INVENTOR(S) : John G. Oldsen It is certified that error appears in the above-identified patent and that said Letters Patent is hereby corrected as shown below:

Column 11, Line 36, Claim 6, after "side" insert a -- , --

Column 12, Line 4, Claim 6, after "end" insert a -- , --

Signed and Sealed this
Sixth Day of March, 2012

David J. Kappos

David J. Kappos
*Director of the United States Patent and Trademark Office*